US005806273A

United States Patent [19]

Kaminski et al.

[11] Patent Number: 5,806,273

[45] Date of Patent: Sep. 15, 1998

[54] MULTI-STOREY CONCRETE CONSTRUCTION SYSTEM

[75] Inventors: Jan Kaminski, Ottawa; Wayne Jennings, Nepean, both of Canada

[73] Assignee: SCI Sitecast International, Inc., Nepean, Canada

[21] Appl. No.: 787,369

[22] Filed: Jan. 22, 1997

[30] Foreign Application Priority Data

Oct. 31, 1906 [CA] Canada ..... 2,189,280

[51] Int. Cl.[6] ..... E04B 2/00

[52] U.S. Cl. ..... 52/586.1; 52/591.2; 52/590.1; 52/591.5; 52/285.1; 52/286; 52/578; 52/609; 404/41

[58] Field of Search ..... 52/586.1, 285.1, 52/286, 250, 253, 506.05, 511, 591.2, 590.1, 591.5, 609, 578; 428/33, 44, 82, 95; 404/41

[56] References Cited

U.S. PATENT DOCUMENTS

| | | | |
|---|---|---|---|
| 3,372,519 | 3/1968 | Russell | 52/583.1 X |
| 3,733,757 | 5/1973 | Scott | 52/250 X |
| 3,762,115 | 10/1973 | McCaul, III et al. | 52/251 X |
| 3,782,061 | 1/1974 | Minutoli et al. | 52/251 X |
| 3,884,005 | 5/1975 | Wey | 52/583.1 |
| 4,571,353 | 2/1986 | Gable, Jr. . | |
| 5,107,652 | 4/1992 | Sosa . | |

FOREIGN PATENT DOCUMENTS

| | | | |
|---|---|---|---|
| 310336 | 9/1929 | Canada . | |
| 338510 | 1/1934 | Canada . | |
| 815795 | 6/1969 | Canada . | |
| 937775 | 12/1973 | Canada . | |
| 1022765 | 12/1977 | Canada . | |
| 1229237 | 11/1987 | Canada . | |
| 1298101 | 7/1988 | Canada . | |
| 2068449 | 5/1992 | Canada . | |
| 1559496 | 9/1969 | Germany | 52/253 |

*Primary Examiner*—Creighton Smith
*Assistant Examiner*—W. Glenn Edwards
*Attorney, Agent, or Firm*—Nixon & Vanderhye P.C.

[57] ABSTRACT

A concrete construction system enabling the construction of multi-storey buildings using single storey wall panels and elevated flat slabs is provided. The invention provides a plurality of concrete panels of a uniform thickness, the plurality of concrete panels including wall and floor panels, wherein the floor panels are interconnected with abutting floor panels with a tongue and channel system so as to properly support the floor panels on the supporting wall.

4 Claims, 3 Drawing Sheets

MULTI-STOREY CONCRETE CONSTRUCTION SYSTEM

The present invention relates to a concrete construction system enabling efficient construction of buildings using concrete slabs.

BACKGROUND OF THE INVENTION

In numerous locations around the globe, there is a need for low cost and easily-fabricated housing to meet the housing requirements of many people in either their native rural regions or in growing urban areas. This is particularly true in third world countries.

For example, in areas where lumber materials are scarce or unavailable, it is often difficult to provide adequate housing for people from locally available construction materials. Accordingly, it is often required that construction materials are brought into an area or pre-fabricated housing components are used to build housing in that particular area. Further problems arise when the location of a building site is distant from a supplier of materials or a manufacturing facility where transportation of materials is either difficult, expensive or impossible. In order to solve such problems, housing projects in particular locations often use concrete components to form basic housing structures. The advantages of concrete components are that they are durable and inexpensive when used in the manufacture of housing units and that, often, some or all of the stone/sand/water/cement ingredients may be available locally. Furthermore, the transportation of concrete ingredients is generally easier and less expensive than transporting pre-formed components. The disadvantage of using concrete components is the difficulty and expense of transporting pre-formed components from a manufacturing facility to a particular work site.

An effective and efficient system of overcoming some of the above problems is to manufacture concrete components on-site and assemble them into housing structures using tilt-up construction techniques. With this technique, concrete wall and floor components are cast to a uniform standard at a specific construction site utilizing an on-site casting bed to build the required components. Such a casting bed is typically a large flat and level concrete surface built directly on the ground at a suitable location at the work site. The casting bed is preferably sufficiently large to allow the manufacture of sufficient concrete components for a single dwelling or single storey to be made side by side. For example, the casting bed could allow for the construction of all wall, interior walls and roofing panels to be built simultaneously on the casting bed.

With most concrete components, the poured concrete will typically require a full seven days to cure in order to ensure that it is sufficiently strong to be moved. Accordingly, concrete components after pouring should be allowed to cure in-situ for at least seven days to allow for sufficient component strength to develop.

It is, however, inefficient to leave a fabrication site dormant for seven days after pouring a single concrete slab, as considerable time is wasted at the work site waiting for the concrete to cure. Similarly, it is inefficient to fabricate numerous casting beds to enable many concrete components to be poured.

Accordingly, in order to overcome this problem, a single casting bed may be fabricated permitting identical components to be cast one on top of the other.

As indicated above, it would be inefficient to use the casting bed for a single housing unit at a time as only a single housing unit could be built every seven days. Accordingly, it is desirable to enable identical components to be poured each day, one on top of the other on the casting bed, in order to allow a larger number of units to be fabricated within a specific period of time.

Accordingly, if seven identical components can be cast one on top of the other on successive days and, following the last casting, allowed to cure for seven days, components for a total of seven housing units could be manufactured in a total of 14 days (seven days of casting, followed by seven days of curing for the entire stack of components). Thus, the average time to prepare components for each housing unit would only be two days.

In regions where this form of construction is utilized, this method can allow for the efficient utilization of equipment and labour as various construction crews can be kept working with less idle time.

Thus, in order to ensure that the manufacture of concrete components progresses efficiently, a forming system which is easily assembled and adjustable to ensure that each concrete component is fabricated within strict tolerances has been developed and is described in applicant's copending United States Application (filed Oct. 16, 1996 to a Concrete Forming System for Stack Construction, Ser. No. 08/731, 553 Inventor: Jan Kaminski) and is incorporated herein by reference.

In urban centers, multiple storey buildings are the most efficient way of utilizing land in housing projects. However, traditional methods of building multiple storey buildings from concrete have a number of inherent problems for certain projects.

For example, in normal concrete construction, a supported concrete floor is poured on top of the supporting walls using a series of underlying forms and supports. With this construction method, after the concrete walls have been poured, a series of supporting forms are positioned and adjusted within the walls prior to pouring a floor of concrete. After pouring the floor, and letting it cure, the supporting forms are removed and reassembled for building successive floors according to the same method. This system of construction is both costly in terms of materials and labour in setting up the forms and pouring the concrete.

Other construction techniques include pre-fabricated panel systems which are pre-cast at a factory and shipped to a construction site. As indicated above, construction with factory manufactured panels is difficult for particular building projects particularly with respect to the difficulty and costs associated with transportation.

Still further, and as indicated above, on-site slab construction represents a different type of construction with concrete. In slab construction, concrete slabs are poured on a work surface at ground level and, after curing are tilted or lifted into position to create a building. Once in position each separate slab or panel is interconnected to another slab or panel and permanently connected to adjacent panels or slabs. Connection is usually achieved by welding steel plates together which have been embedded in the concrete at strategic locations or using an appropriate nut and bolt system.

In the past, the problem with slab construction for multiple storey buildings is that large concrete slabs used in creating a floor cannot be made too large as the larger a floor slab becomes, the more difficult it becomes to move the slab into position with a crane. Thus, it is often required that for a particular building design, a concrete floor slab must fabricated in more than one piece. While smaller floor slabs can be poured, they must be properly supported by the underlying walls. While it is straightforward to support a concrete slab on a supporting wall where it is fully supported across the thickness of the supporting wall, difficulties arise in supporting abutting or adjacent concrete slabs on a shared supporting wall. For example, the typical thickness of a concrete supporting wall and floor slab is 4–8". Thus, in the situation where the floor slab is supported by the complete 4–8 " thickness of the vertical wall, a full 4–8 " would be available to support the floor slab which provides an adequate margin of safety.

The support on a floor slab becomes problematic where abutting floor sections must be supported by the same vertical supporting wall. In this situation, each abutting floor section overlaps with the interior wall by only one half of the total thickness of the vertical wall, that is typically 2–4" which does always ensure an adequate margin of safety.

Thus, there has been a need to develop a concrete construction and concrete panel system which enables construction of multiple storey buildings without the disadvantages associated with conventional concrete construction techniques or tilt-up construction techniques. In particular, there has been a need for a system which enables abutting floor slabs to be properly supported by the underlying support wall.

Still further, there has been a need for a construction system, in which floor slabs can be manufactured at a size permitting their movement by a mobile crane.

Still further, there has been a need for a construction system, where each component, be it a wall panel, interior wall or floor slab is manufactured to a uniform thickness in order to simplify on-site manufacture of the concrete slabs and permit the use of stack construction techniques.

A review of the prior art has revealed a number of references such Canadian Patent 338,510, Canadian Patent 937,775, Canadian Patent 1,229,237, Canadian Patent 1,022,765, Canadian Patent 1,298,101, Canadian Patent 815,795, Canadian Patent Application 2,068,449, Canadian Patent 310,336 and U.S. Pat. No. 4,571,353 which disclose various concrete construction methods or structures.

SUMMARY OF THE INVENTION

In accordance with the invention, a concrete construction system is provided, the concrete construction system comprising:

a plurality of concrete panels of a uniform thickness, the plurality of concrete panels including wall and floor panels, wherein the floor panels include means for interconnection with at least one abutting floor panel and means for support on the wall panels.

In further embodiments, the concrete floor panel includes:

a) a tongue and channel system along at least one edge for interconnection with an abutting floor panel, wherein each tongue is adapted for fitting within the channel of an abutting panel and wherein the depth of each tongue and channel corresponds to the thickness of the underlying wall panel;

b) means for attaching the concrete slab to the supporting wall.

A still further embodiment provides that the width of a tongue is less than the width of a corresponding channel and wherein each corresponding tongue and channel define a cavity between adjacent floor panels when assembled and wherein the means for attaching includes at least one first steel plate embedded within the channel and at least one second steel plate embedded within the top surface of the supporting wall adjacent the at least one first steel plate, the at least one first and second steel plates enabling permanent interconnection by welding from within the cavity. Preferably, the thickness of the panels are 4–8".

The invention also provides a concrete floor panel adapted for interconnection with at least one abutting concrete floor panel and for support from an underlying supporting wall, the concrete floor panel comprising:

a concrete slab of uniform thickness, the concrete slab including a tongue and channel system along at least one edge for interconnection with an abutting floor panel wherein each tongue is adapted for fitting within the channel of an abutting panel, wherein the depth of each tongue and channel corresponds to the thickness of the underlying supporting wall;

means for attaching the concrete slab to the supporting wall.

In a method in accordance with the invention, a method of building a multiple storey building is provided comprising the steps of:

a) casting a plurality of concrete panels of a uniform thickness on-site, the plurality of concrete panels including wall and floor panels, wherein the floor panels include a tongue and channel system along at least one edge for interconnection with an abutting floor panel, wherein each tongue is adapted for fitting within the channel of an abutting panel and wherein the depth of each tongue and channel corresponds to the thickness of the wall panel;

b) lifting and securing the wall panels to form supporting walls for supporting the floor panels;

c) lifting the floor panels atop the supporting walls and interconnecting the floor panels such that corresponding tongues and channels interconnect and are equally supported atop the supporting wall;

d) securing said interconnected floor panels to the supporting walls;

e) repeating steps b) to d) for each storey of the building.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
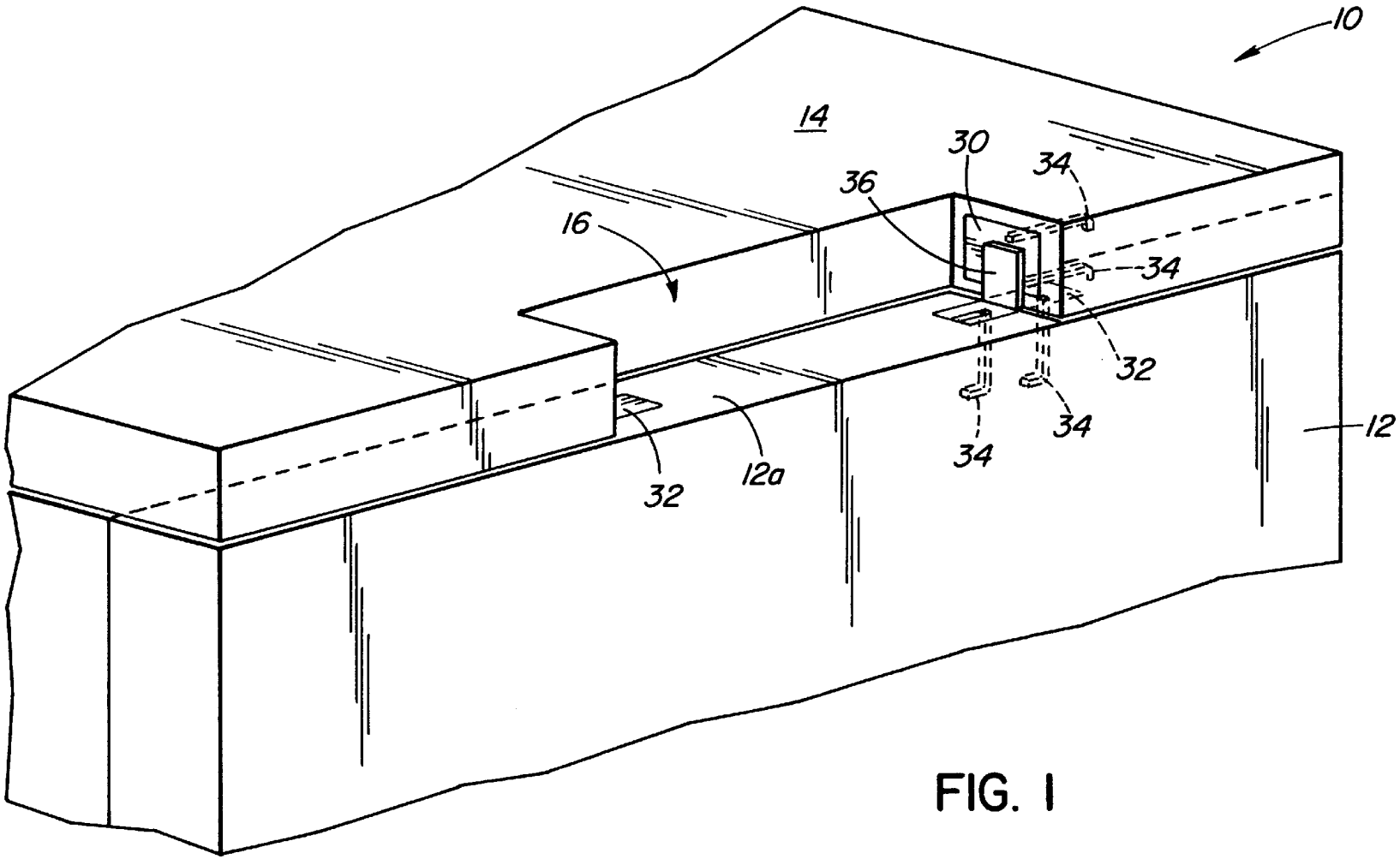
FIG. 1 is a perspective view of a concrete wall and floor slab in accordance with the invention showing the recessed channel.
Figure 2:
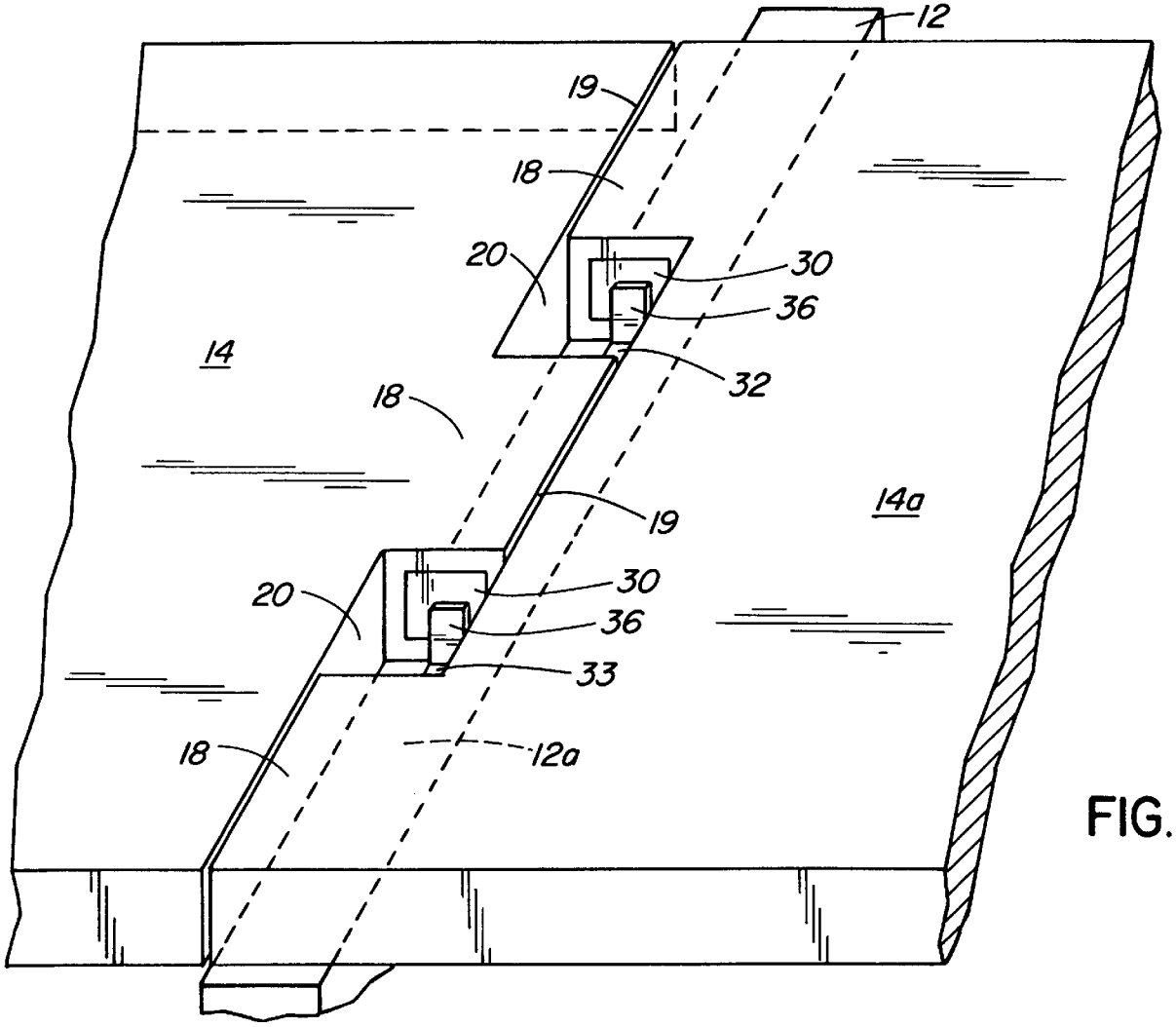
FIG. 2 is a perspective view of assembled floor slabs and wall in accordance with the invention.
Figure 3:
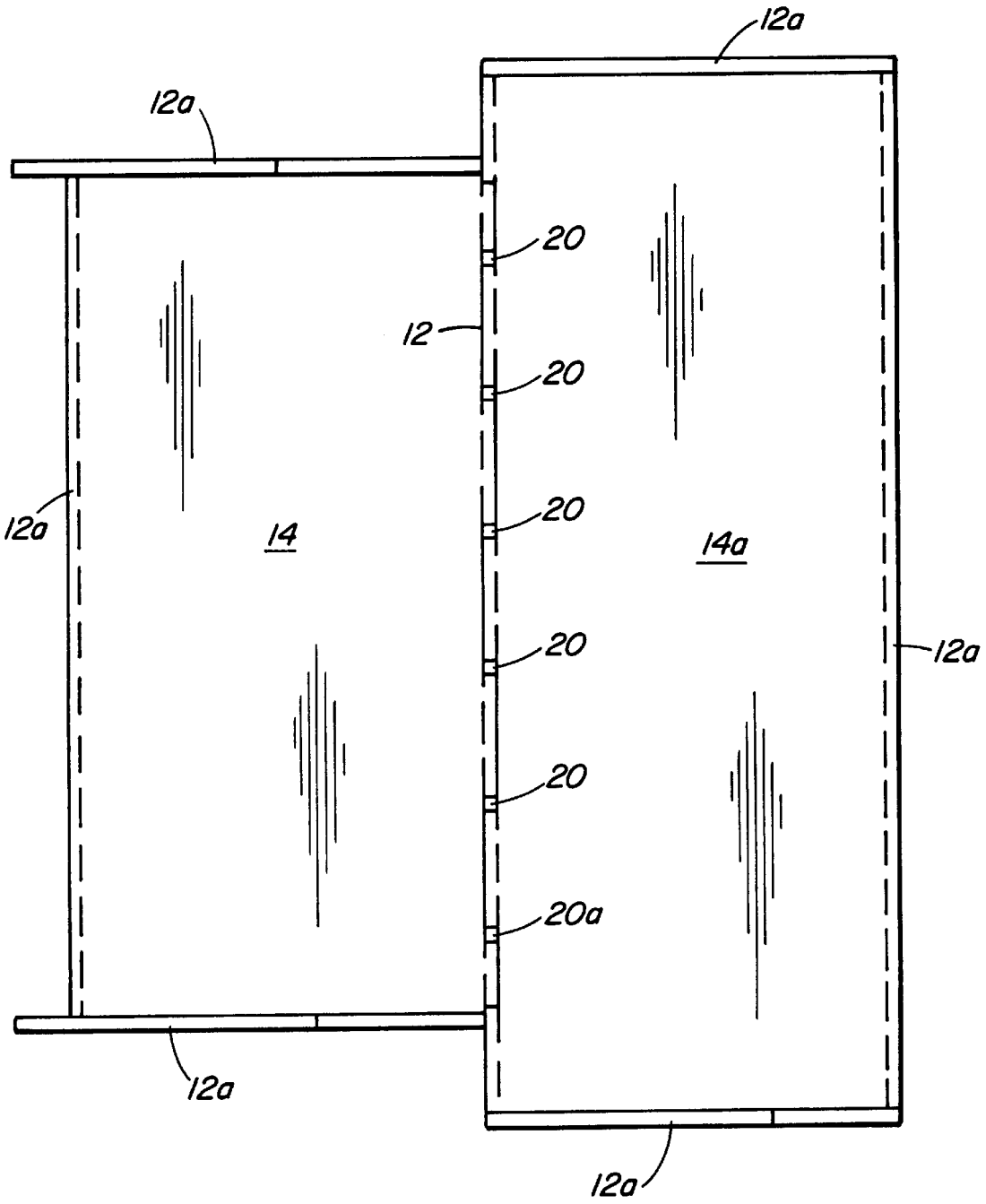
FIG. 3 is a plan view of building site utilizing the floor slab and wall system of the invention.

A concrete floor slab and wall system 10 in accordance with the invention is shown in FIGS. 1–3. The system 10 includes a vertical wall 12 and a floor slab 14 resting on the vertical wall 12. FIG. 1 shows a single floor slab 14 resting on a vertical wall 12, the floor slab having a cut-away portion 16 which exposes a portion of the top surface 12*a* of the vertical wall 12. FIG. 2 shows two abutting floor slabs 14 and 14*a* interlocking with respect to one another and resting on the vertical wall 12. As shown, each floor slab 14 and 14*a* has corresponding tongues 18 and channels 19 which allow for floor slabs 14 and 14*a* to interlock. As can be seen from FIGS. 1 and 2, metal plates 30 and 32 are configured and anchored to the concrete slabs using conventional anchoring techniques such as j-bolts 34 embedded within the concrete. The metal plates 30, 32 are positioned so that each slab may be permanently attached to one another after assembly. Typically, the metal plates 30,32 may be welded to one another using a further metal plate 36.

As shown in FIGS. 2 and 3, an opening or volume 20 is provided between each adjacent tongue 18 and channel 19 to provide sufficient space to enable the slabs 12, 14 and 14*a* to be permanently attached to one another. It can be appreciated from the Figures that the attachment procedure can be completed from the upper surface of the slabs 14 and 14*a* by placing metal plate 36 against plates 30 and 32 and welding plate 36 to plates 30 and 32.

The relative dimensions of each tongue 18 and channel 19 are preferably maintained to provide a small gap (0.25"–1") around the abutting surfaces so as to accommodate construction tolerances between panels.

Construction Method

The floor slab system, in accordance with the invention, is preferably used to build a multiple storey building using single storey wall panels and elevated flat slabs. The wall panels and floor slab will preferably utilize an on-site casting system, such as that disclosed in applicant's co-pending United States Application (filed Oct. 16, 1996 to a Concrete Forming System for Stack Construction, Ser. No. 08/731,553, Inventor: Jan Kaminski) and incorporated herein by reference.

Each wall and/or floor component is cast on-site on a work surface, and following an appropriate curing time, each wall panel is lifted and positioned in place utilizing a mobile crane. Each wall panel is then secured in place using temporary bracing as is understood in the art until permanent connections can be made. Typically, each wall panel will be provided with appropriate steel plates and/or bolts embedded or anchored within the concrete which may then be welded or bolted together. Once the vertical walls have been permanently connected, the floor slabs 14 and 14*a* are lifted into place on top of the walls and positioned such that the tongues 18 and channels 19 interlock with one another as shown in FIGS. 2 and 3. As with the wall panels, appropriated positioned steel plates or bolts are located within the vertical wall and flooring slabs 14, 14*a* which remain exposed within opening 20 in order to permit permanent connection between the floor slabs 14, 14*a* and the vertical wall thereby creating a permanent structure. As indicated above, an appropriate weld can be made between adjacent metal plates 30,32 by an additional metal plate 36. The flooring slabs and wall panels, once permanently connected, function as a stable structural unit.

This process may be repeated floor level by floor level in order to create a multiple storey building.

The tongue and channel system, as described above, achieves proper support with the floors slabs 14 and 14*a* abutting on a common bearing wall and thereby achieving proper bearing while minimizing the thickness of the bearing wall. Furthermore, the system in accordance with the invention permits all connection welds as described above to be hidden as each connection is made within cavity 20 which becomes hidden as successive floors are assembled over the cavities 20. Wall and floor slabs can be manufactured with thickness in the range of 4–8" and provide adequate bearing support while minimizing the quantity of concrete required.

Alternatively, the interlocking floor slabs can be fabricated with a tongue and channel system without the openings 20 wherein the width of the tongues is only slightly smaller than those of the corresponding channels. In order to effect attachment of the floor slabs to the supporting wall 12 and/or an adjacent floor slab 14, appropriate metal plates may be provided on the underside and/or topside of the floor slabs 14 to permit welding as described above. In this embodiment, any welds may be exposed.

Thus, the present construction system provides an effective and efficient system of enabling multiple storey buildings to be fabricated without steel joists or specialized floor or wall panels.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

We claim:

1. A concrete construction system comprising:

a plurality of concrete panels of a uniform thickness, the plurality of concrete panels including wall and floor panels, wherein the floor panels include means for interconnection with at least one abutting floor panel and means for support on the wall panels and wherein each concrete floor panel includes:

a. a tongue and channel system alone at least one edge for interconnection with an abutting floor panel, wherein each tongue is adapted for fitting within the channel of an abutting panel and wherein the width of a tongue is less than the width of a corresponding channel such that each corresponding tongue and channel define a cavity between adjacent floor panels when assembled;

b. means for attaching said concrete floor panel to a supporting wall wherein the means for attaching includes at least one first steel plate embedded within an outer surface of the channel and at least one second steel plate embedded within a top surface of the supporting wall panel adjacent the at least one first steel plate, wherein the at least one first and second steel plates are flush with the outer surface of the channel and top surface of the supporting wall panel, respectively, the first and second steel plates enabling permanent interconnection by welding from within the cavity.

2. A concrete floor panel adapted for interconnection with at least one abutting concrete floor panel and for support from an underlying supporting wall, the concrete floor panel comprising:

a. a concrete slab of uniform thickness, the concrete slab including a tongue and channel system along at least one edge for interconnection with an abutting floor panel wherein each tongue is adapted for fitting within the channel of an abutting panel, wherein the width of a tongue is less than the width of a corresponding channel such that each corresponding tongue and channel define a cavity between adjacent floor panels when assembled;

b. means for attaching the concrete slab to the supporting wall wherein the means for attaching includes at least one first steel plate embedded within the channel, the steel plate flush on the outer surface of the panel.

3. A method of building a multiple storey building comprising the steps of:

a. casting a plurality of concrete panels of a uniform thickness on-site, the plurality of concrete panels including wall and floor panels, wherein the floor panels include a tongue and channel system along at least one edge for interconnection with an abutting floor panel, wherein each tongue is adapted for fitting within the channel of an abutting panel wherein the width of a tongue is less than the width of a corresponding channel such that each corresponding tongue and channel define a cavity between adjacent floor panels when assembled, the concrete panels including means for attaching the wall and floor panels wherein the means for attaching includes at least one first steel plate embedded within an outer surface of the channel of a floor panel and at least one second steel plate embedded within a top surface of the wall panel adjacent the at least one first steel plate, wherein the at least one first and second steel plates are flush with the outer surface of the channel and top surface of the wall panel, respectively, the first and second steel plates enabling permanent interconnection by welding from within the cavity;

b. lifting and securing the wall panels to form supporting walls for supporting the floor panels;

c. lifting the floor panels atop the supporting walls and interconnecting the floor panels such that corresponding tongues and channels interconnect and are equally supported atop the supporting wall;

d. securing said interconnected floor panels to the supporting walls;

e. repeating steps b) to d) for each storey of the building.

4. A concrete construction system as in claim 1 wherein the depth of each tongue and channel corresponds to the thickness of the underlying wall panel.

* * * * *

UNITED STATES PATENT AND TRADEMARK OFFICE

CERTIFICATE OF CORRECTION

PATENT NO. : 5,806,273
DATED : September 15, 1998
INVENTOR(S) : Jan KAMINSKI et al

It is certified that error appears in the above-identified patent and that said letters patent is hereby corrected as shown below:

Column 6, claim 1(a), line 26, change "alone" to -along-.

Column 6, claim 2(b), line 62, change "on the" to -with an-.

Title page, item [30]

Foreign Application Priority Data, priority date, change "Oct. 31, 1906: to -Oct. 31, 1996-.

Signed and Sealed this

Twenty-first Day of September, 1999

*Attest:*

Q. TODD DICKINSON

*Attesting Officer*

*Acting Commissioner of Patents and Trademarks*